US005732869A

United States Patent [19]

Hirtl

[11] Patent Number: 5,732,869

[45] Date of Patent: Mar. 31, 1998

[54] EXPLOSIVE POWDER CHARGE OPERATED SETTING TOOL

[75] Inventor: Anton Hirtl, Gams, Switzerland

[73] Assignee: Hilti Aktiengesellschaft, Schann, Liechtenstein

[21] Appl. No.: 743,441

[22] Filed: Nov. 1, 1996

[30] Foreign Application Priority Data

Nov. 27, 1995 [DE] Germany ..... 195 44 104.4

[51] Int. Cl.[6] ..... B25C 1/04

[52] U.S. Cl. ..... 227/10

[58] Field of Search ..... 227/9, 10, 11, 227/129, 130

[56] References Cited

U.S. PATENT DOCUMENTS 4,382,533 5/1983 Buechel et al. ..... 227/10

4,883,212 11/1989 Philipp ..... 227/9

5,029,744 7/1991 Pai ..... 227/10

5,213,247 5/1993 Gschwend et al. ..... 227/10

*Primary Examiner*—Scott A. Smith

*Attorney, Agent, or Firm*—Anderson, Kill & Olick, P.C.

[57] ABSTRACT

An explosive powder charge operated setting tool drives fastening elements, such as bolts, nails, and the like into hard receiving materials. The setting tool has a housing (1) with a piston guide (2) including a cartridge chamber (6) axially displaceable in the housing. A driving piston (4) is axially displaceable in a guide bore (5) in the piston guide. A firing pin guide (3) is located in the housing rearwardly of the piston guide and is displaceable parallel to the driving direction of the tool. An inertia mass (12) cooperates with a control member (17) for regulating the power output of the tool.

10 Claims, 3 Drawing Sheets

EXPLOSIVE POWDER CHARGE OPERATED SETTING TOOL

BACKGROUND OF THE INVENTION

The present invention is directed to an explosive powder charge operated setting tool for driving fastening elements, such as bolts, nails and the like, into hard receiving materials. The tool includes a housing with an axially displaceable piston guide containing a cartridge chamber in the housing. A driving piston is axially displaceable in a guide bore in the piston guide and a firing pin guide is located in the housing rearwardly of the piston guide.

An explosive powder charge operated setting tool is disclosed in EP-0 467 834 B1 and is used for driving fastening elements such as bolts, nails and the like, into hard receiving materials.

The setting tool includes a housing with a handle and an operating switch located in the handle. A piston guide is positioned within the housing and a driving piston is movably displaceable in a guide bore of the piston guide. A muzzle part is located ahead of the piston guide and a firing pin guide with a firing mechanism is positioned rearwardly of the piston guide. The piston guide and the firing pin guide are axially displaceable relative to the housing. The firing pin guide is displaceable opposite to the driving direction against the force of a pressure spring bearing against the housing.

A cartridge chamber for receiving a propellant charge is disposed in the end of the piston guide facing toward the firing pin guide. The firing mechanism in the firing pin guide has a firing pin which is preloaded or cocked when the piston guide is axially displaced opposite to the firing or driving direction. A spring element cooperating with the firing pin is compressed in the cocked position. When the operating switch is pressed, the cocked firing pin is released and is accelerated in the direction of the cartridge chamber and, upon striking the cartridge charge ignites it. Propellant gases developed upon ignition accelerate the piston guide and the firing pin opposite to the driving direction and the driving piston in the guide bore is driven in the driving direction, so that the driving piston drives a fastening element located in the muzzle part of the setting tool into the receiving material. The rebound force acting on the handle is damped by the pressure spring located between the firing pin guide and the housing.

To achieve a desired penetration depth of the fastening element, different driving energies are required depending on the strength characteristic of the receiving material. Matching the driving energy can be achieved by the use of cartridges having different explosive power or by the use of a power output control. In both cases, however, matching the driving energy depends upon the capability of the tool operator. In the presence of excessive driving power, the, fastening element is either driven too deeply into the receiving material or it can penetrate through thin receiving material at high speed. This heightens the risk of injury for persons located behind the thin receiving material.

SUMMARY OF THE INVENTION

Therefore, the primary object of the present invention is to provide an explosive powder charge operated setting tool which affords a high degree of safety independent of the capability of the tool operator and which can be manufactured simply and economically.

In accordance with the present invention, an inertia mass cooperates with a control element and serves to regulate the power output of the setting tool.

The setting tool of the present invention has a power regulating control element cooperating with an inertia mass which partially diverts the excess energy of the propellant charge pressure to the atmosphere, if, for example, excessively powerful cartridges are used. As a result, the driving piston is accelerated to a lesser degree and the fastening element is driven to the desired depth into the receiving material.

The control element is actuated by the inertia mass in the course of a setting procedure which is displaced parallel to the setting direction.

Preferably, an actuation element cooperates with the control element so that an adjustment can take place by means of the inertia mass.

The actuation element is preferably a spindle having a steep thread for engagement with the inertia mass. The spindle is turned when the inertia mass is accelerated in the axial direction. This rotary movement serves for adjusting a control element. The slope of the steep thread is in the range of 50°–70°.

A friction device acts on the spindle, so that the spindle does not turn when the inertia mass is restored to its initial position. The frictional force generated acts against rotation of the spindle, whereby a turning of the inertia mass relative to the spindle takes place when the mass is returned to its initial position.

Preferably, the inertia mass is displaceable against the force of a spring element. During a setting procedure, the inertia mass, accelerated in a direction parallel to the driving direction, prestresses or preloads the spring element, and after the setting procedure, returns the inertia mass into its initial position.

The diversion of excess energy of a portion of the propellant gases to the atmosphere is effected by a control element formed as a slide cooperating with a blow-off opening from the guide bore. For instance, the slide can be shaped as a pin, axially displaceable in a receiving bore, and arranged perpendicularly to the blow-off opening. The portion of the pin which at least partially extends across the entrance to the blow-off opening can have an outside shape tapering in a cone-shaped manner, so that the cross section of the blow off opening changes when the pin is axially displaced.

The spindle is supported in the firing pin guide so that it is freely rotatable and displaceable parallel to the driving direction so that the control element is actuated when the firing pin guide is axially displaced.

In powder charge operated setting tools with an axially displaceable piston guide and an axially displaceable firing pin guide, the piston guide and firing pin guide are accelerated opposite to the driving direction during each setting operation. The piston guide and the firing pin guide cooperate with a damping device located between the firing pin guide and the rear end of the housing. In the course of a normal setting operation, the mass composed of the piston guide and the firing pin guide compresses the damping element very strongly when the firing pin guide contacts the damping element, so that a considerable amount of kinetic energy is dissipated. When the damping element expands, the piston guide and the firing pin guide are moved in the driving direction. During such movement, the displacement velocity is rather small whereby an axial movement of the inertia mass relative to the firing pin guide does not take place.

During a setting procedure with excess energy, the propelling driving piston is accelerated in the driving direction and arrives in the region of a piston brake connected to the piston guide. The piston brake prevents an acceleration of the piston guide opposite to the driving direction so that only the firing pin guide is accelerated opposite to the driving direction. Since the firing pin guide has a very small mass, it is accelerated to a considerable extent when it strikes the damping element. The displacement velocity of the firing pin guide is quite high, whereby an axial movement of the inertia mass relative to the firing pin guide and an axial movement of the pin relative to the blow-off opening occurs. Preferably, the spindle is supported in the housing so as to be freely rotatable for the actuation of the control element to take place, if the housing of the explosive powder charge operating setting tool experiences a recoil or rebound.

Manual actuation of the control element or of the spindle is possible, if a regulating wheel is connected to the spindle. The regulating wheel is connected to the spindle so that it is not rotatable relative to it and permits adjusting the spindle manually. The regulating wheel protrudes at least partially from the outside contour of the setting tool.

While specific embodiments of the invention have been shown and described in detail to illustrate the inventive principles, it will be understood that the invention may be embodied otherwise without departing from such principles.

DETAILED DESCRIPTION OF THE INVENTION

Figure 1:
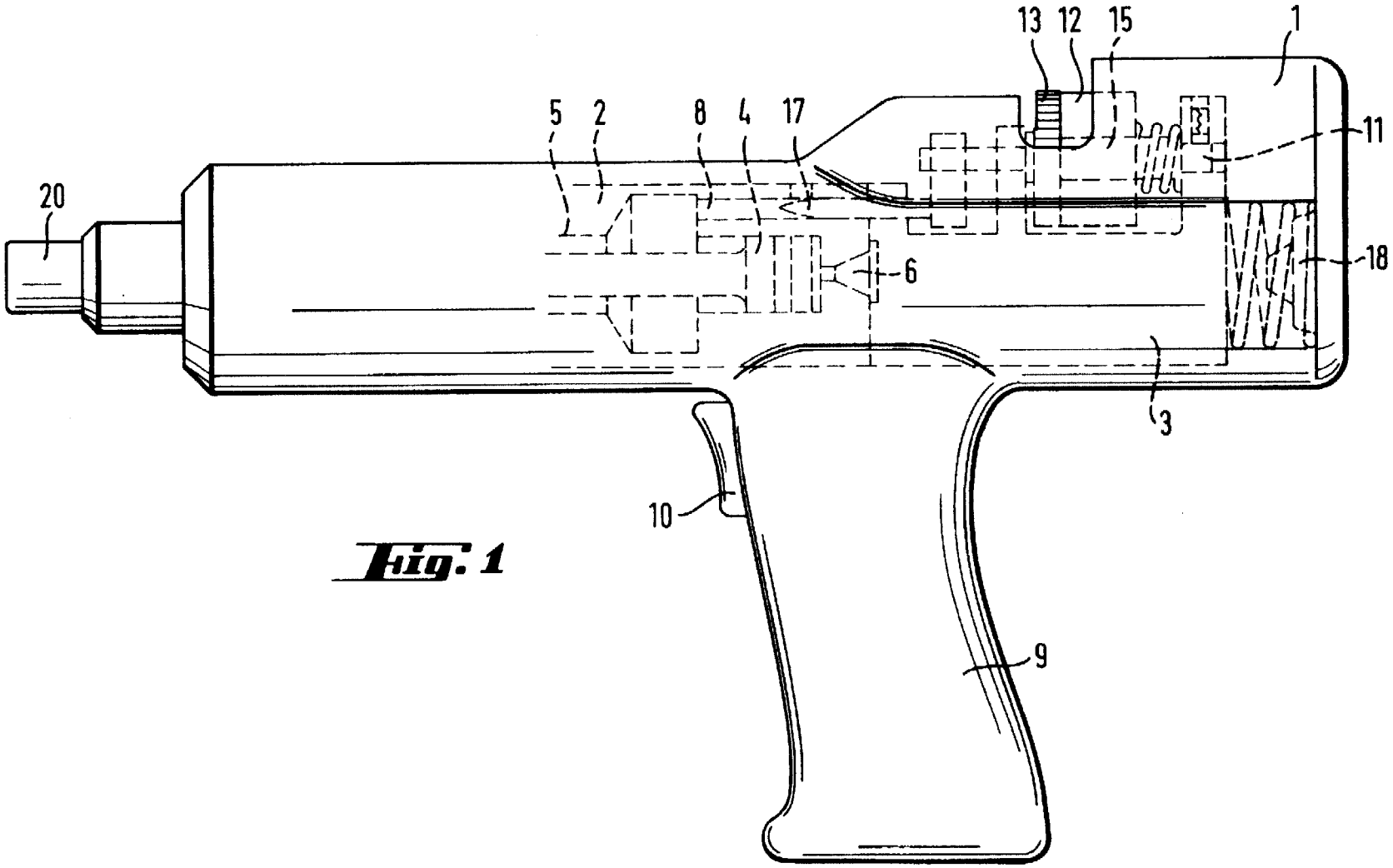
FIG. 1 is a diagrammatic showing of an explosive powder charge operated setting tool embodying the present invention.

In FIG. 1 an explosive powder charge operating tool is shown for driving fastening elements, such as bolts, nails and the like, into a hard receiving material, not shown. The setting tool has a housing 1 with a leading or front end at the left hand side and a trailing or rear end at the right hand side. A bolt guide 20, for receiving a fastening element, not shown, is axially displaceable relative to the housing 1 and extends axially outwardly from the front end of the housing 1. A handle 9 incorporating an operating switch 10 is located adjacent the rear end of the housing. A regulator wheel 13 and an inertia mass 12 can be seen in the region of an opening near the trailing end of the housing 1.

Figure 2:
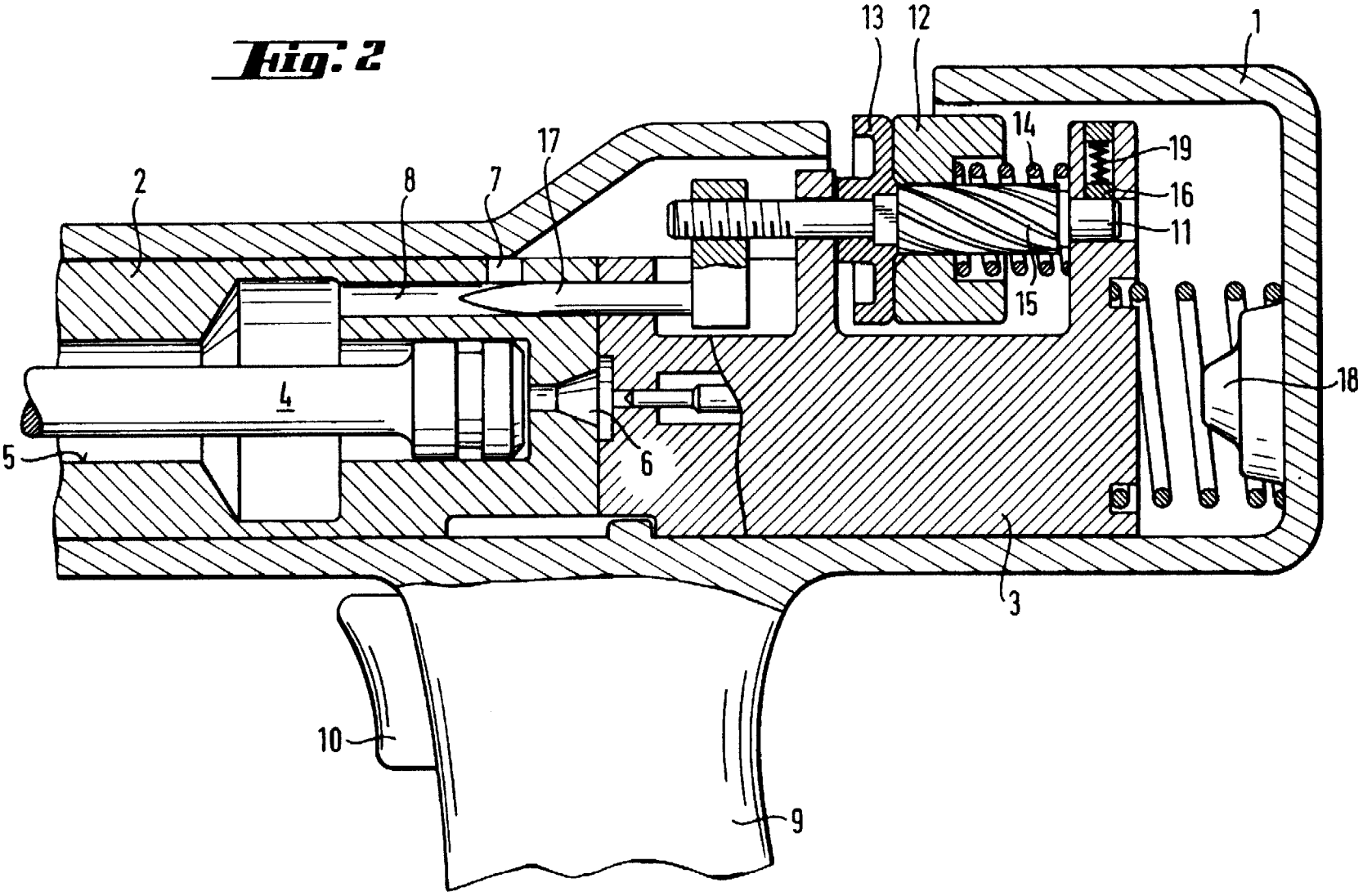
FIG. 2 is a side view of the rear region of the setting tool shown in FIG. 1 in a sectioned and enlarged view.

In the enlarged showing of the housing 1 in FIG. 2 there is a piston guide 2 with a cartridge chamber 6 at its trailing end and the piston guide is axially displaceable relative to the housing. A driving piston 4 is axially displaceable in a guide bore 5 in the piston guide. A blow-off opening 7 extending perpendicularly to the guide bore 5 is open to the atmosphere and is located in the piston guide between the driving piston 4 and the cartridge chamber 6. A control element 17 in the form of a pin tapering at its leading end in a cone-shaped manner is designed to change the area of the entrance into the blow-off opening 7. The control element or pin 17 is arranged to be axially displaceable in a bore 8 extending perpendicularly to the blow-off opening 7 and parallel to the guide bore 5 so that its cone-shaped end extends at least partly across the entrance into the blow-off opening 7.

A firing pin guide 3 is located rearwardly of the piston guide 2 and is axially displaceable relative to the housing 1. As can be seen in the position illustrated in FIG. 2, the leading end of the firing pin guide 3 abuts the trailing end of the piston guide 2. An axially extending spindle 11 is rotatably supported in the firing pin guide. An inertia mass 12 is positioned on the spindle 11 and is rotationally connected to it by a steep thread 15 on the spindle so that it rotates. The thread has an angle of 60°.

The firing pin guide 3 has a first bearing support in its trailing end region and receives a trailing end of the spindle 11. A friction element 16, biased by a spring 19, is located adjacent the first bearing support and presses radially inwardly against the surface of the spindle 11 so that the spindle cannot be easily turned. A spring element 14 is located between a stop face on the firing pin guide, directed in the driving direction, and the inertia mass 12. The spring element 14 presses the inertia mass 12 against a regulating wheel 13 connected to the spindle 11 so that it rotates with the spindle. A second bearing support in the front end region of the firing pin guide 3 also supports the spindle 11 forwardly. The second bearing support is located between the regulating wheel 13 and a leading end of the spindle 11. The free end of the spindle 11 has an outside thread rotating clockwise at its leading end and cooperates with a matching internal thread on the control element 17.

If the setting tool of the present invention is actuated with excess energy, the driving piston 4 is interrupted or intercepted by a piston brake, not shown. Initially, the piston guide 2 is accelerated opposite to the driving direction by the propellant gas pressure developed when the cartridge is ignited and is prevented from further axial displacement, whereby only the firing pin guide is accelerated opposite to the setting direction and strikes a damping element 18 located between the firing pin guide 3 and the trailing end of the housing. When the firing pin guide 3 rebounds from the damping element 18, the inertia mass 12 moves opposite to the driving direction and at least partially compresses the spring element 14. Because of the large size of the inertia mass 12, it does not turn relative to the spindle 11, rather the spindle 11 rotates relative to the inertia mass. Accordingly, there is a right-hand rotation of the spindle 11 and an axial displacement of the control element 17 opposite to the driving direction. In this manner the internal area of the entrance to the blow-off opening 7 is enlarged and a portion of the propellant gases escape to the atmosphere without any interference during the following setting operation.

The compressed spring element 14 returns the inertia mass 12 to its initial position. This return movement is relatively slow and since the spindle 11 cannot be easily turned due to the action of the friction element 16, rotation occurs between the inertia mass 12 and the steep thread 15 relative to the spindle until the inertia mass again arrives at its initial position.

Axial movement of the control element 17, can be effected if the regulating wheel 13 is actuated manually. A pressure spring arranged between the firing pin guide and a stop face at the rear end of the housing serves, after a setting procedure, for returning the firing pin guide into its initial position. In the initial position the firing pin guide abuts against a stop formed on the housing located between the piston guide and the firing pin guide.

Figure 3:
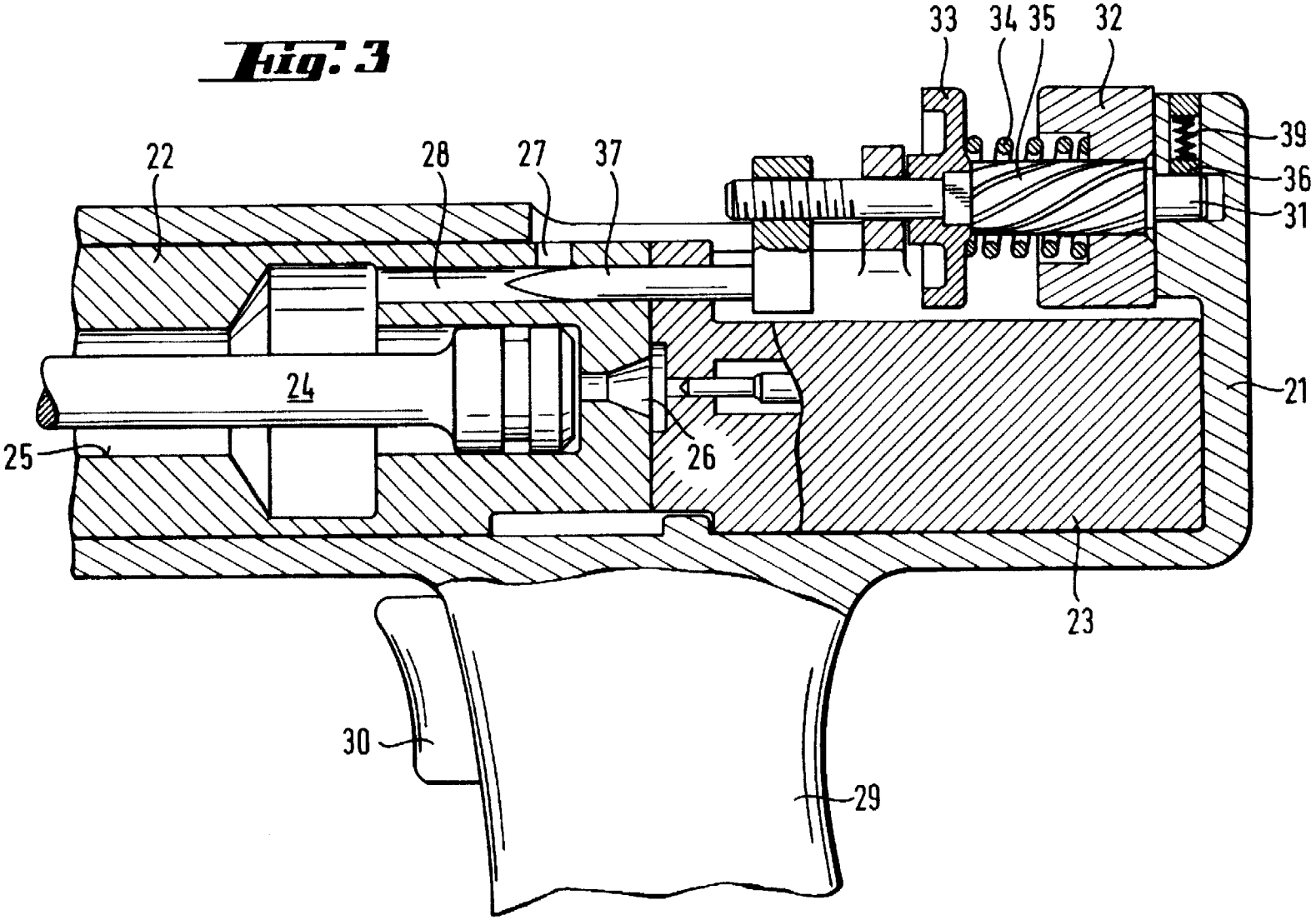
FIG. 3 is a view similar to FIG. 2 of another setting tool embodying the present invention.

In FIG. 3 another embodiment of the present invention is illustrated and includes a housing 21 containing a piston guide 22 including a cartridge chamber 26 which is axially displaceable relative to the housing. A drive piston 24 is axially displaceable in a guide bore 25 in the piston guide 22. A blow-off opening 27 communicating with the atmosphere extends perpendicularly to the guide bore 25 through the piston guide 22 and is located between the drive piston 24 and the cartridge chamber 26. An axially extending control element 37, in the form of a pin with an inwardly tapering or conically shaped leading end is arranged to change the cross section of the entrance into the blow-off opening 27. The control element or pin 37 is axially displaceable in a bore 28 in the piston guide and extends perpendicularly to the blow-off opening 27 and parallel to the guide bore 25. The conically-shaped leading end of the pin 37 extends at least partially across the entrance into the blow-off opening 27.

A firing pin guide 23 is located in the housing 21 rearwardly of the piston guide 22. A spindle 31 is rotatably supported at its rear end in the housing 21. An inertia mass 32 is mounted on the spindle 31 and is connected to it by a steep thread 35 arranged for counterclockwise rotation. The thread has an angle of 60 degrees.

At its trailing end, housing 21 has a first bearing support for a trailing end of the spindle 31. A friction element 36 biased by a spring 39 is located in the region of the first bearing support and is pressed against the friction element 36 so that it cannot be easily turned. A second bearing support in the housing 21 rotatably supports the spindle 31 toward its leading end. A regulating wheel 33 is located between the second bearing support in the housing 21 and the inertia mass 32 and the regulating wheel is connected to the spindle so that they rotate together.

A spring element 34 is positioned between a stop face on the regulating wheel 33 directed opposite to the driving direction and the inertia mass 32 with the spring element pressing the inertia mass against the first bearing support in the housing 21. The leading end of the spindle 31 has a clockwise rotating outside thread that cooperates with a matching internal thread in the control member 37.

If the setting tool of the present invention is operated with excess energy, the rebound force accelerates the housing very rapidly opposite to the driving direction. This results in a displacement of the inertia mass 32 in the driving direction and at least partially compresses the spring element 34. Because of the large size of the inertia mass 32, it does not turn relative to the spindle 31, rather the spindle turns relative to the inertia mass 32. This results in a clockwise rotation of the spindle 31 and in an axial displacement of the control element 37 opposite to the driving direction. Such movement enlarges the entrance area of the blow-off opening 27 so that a portion of the propellant gases can escape to the atmosphere during the following setting procedure.

The compressed spring element 34 effects the return movement of the inertia mass 32. Since this return movement occurs relative slowly and because the spindle cannot be easily turned due to the action of the friction element, the inertia mass 32 turns relative to the spindle along the steep thread 35 until it is returned to its initial position.

If the regulating wheel 33 is actuated manually, an axial displacement of the control member 37 is obtained.

While specific embodiments of the invention have been shown and described in detail to illustrate the inventive principles, it will be understood that the invention may be embodied otherwise without departing from such principles.

What is claimed as new and desired to be protected by Letters Patent is set forth in the appended claims:

1. An explosive powder charge operated setting tool for driving fastening elements, such as bolts, nails and the like into hard receiving materials, comprises a housing (1, 21) having a leading end and a trailing end and a driving direction extending from the trailing end through the leading end, an axially extending piston guide (2, 22) extending in the driving direction and located within said housing, said piston guide having a cartridge chamber (16, 26) in a trailing end thereof, an axially extending driving piston (4, 24) axially displaceably mounted in a guide bore (5, 25) in said piston guide, an axially extending firing pin guide (3, 23) positioned within said housing between a trailing end of said piston guide and the trailing end of said housing, and means in said housing for regulating the force output of said tool, said means comprising an inertia mass (12, 32) displaceable relative to the housing and firing pin guide along the firing direction and a control member (17, 37) cooperating with said inertia mass and displaceable relative to the housing and piston guide along the driving direction.

2. An explosive powder charge operated setting tool, as set forth in claim 1, wherein said inertia mass (12, 32,) cooperates with said control member (17, 37) via an actuation element.

3. An explosive powder charge operated setting tool, as set forth in claim 2, wherein said actuation element is an axially extending spindle (11, 31) having a steep thread (15, 35) formed thereon for threaded engagement with said inertia mass (12, 32).

4. An explosive powder charge operated setting tool, as set forth in claim 3, wherein a friction element (16, 36), acts upon said spindle (11, 31), for limiting the rotation thereof.

5. An explosive powder charge operated setting tool, as set forth in one of claims 1 to 4, wherein said inertia mass 12, 32) being displaceable against the force of a spring element (14, 34).

6. An explosive powder charge operated setting tool as set forth in claim 1, wherein said control member (17, 37) is a slide cooperating with a blow-off opening (7, 27) in said piston guide (2, 12).

7. An explosive powder charge operated setting tool, as set forth in claim 6, wherein said spindle (11) is supported in said firing pin guide (3) and being displaceable parallel to the driving direction and being freely rotatable.

8. An explosive powder charge operated setting tool, as set forth in claim 7, wherein a damping element (18) is located between a trailing end of said firing piston guide (3) and the trailing end of said housing (1).

9. An explosive power charge operated setting tool, as set forth in claim 6, wherein said spindle (31) is freely rotatably supported in said housing (21).

10. An explosive powder charge operated setting tool, as set forth in claim 3, wherein a regulating wheel (13, 23) is connected to said spindle (11, 31) for manually displacing said control member.

* * * * *

UNITED STATES PATENT AND TRADEMARK OFFICE

CERTIFICATEOF CORRECTION

PATENT NO. : 5,732,869

DATED : March 31, 1998

INVENTOR(S) : Anton Hirtl

It is certified that error appears in the above-identified patent and that said Letters Patent is hereby corrected as shown below:

On the title page:

[73] Assignee: Hilti Aktiengesellschaft, Schaan, Liechtenstein

Signed and Sealed this

Second Day of June, 1998

*Attest:*

*Attesting Officer*

Bruce Lehman

BRUCE LEHMAN

*Commissioner of Patents and Trademarks*